US005701830A

United States Patent [19]

Muto

[11] Patent Number: 5,701,830

[45] Date of Patent: Dec. 30, 1997

[54] EMBROIDERY DATA PROCESSING APPARATUS

[75] Inventor: Yukiyoshi Muto, Nagoya, Japan

[73] Assignee: Brother Kogyo Kabushiki Kaisha, Nagoya, Japan

[21] Appl. No.: 622,603

[22] Filed: Mar. 26, 1996

[30] Foreign Application Priority Data

Mar. 30, 1995 [JP] Japan ..... 7-072743

[51] Int. Cl.[6] ..... D05C 5/02

[52] U.S. Cl. ..... 112/102.5

[58] Field of Search ..... 112/102.5, 470.06, 112/103, 454, 475.19

[56] References Cited

U.S. PATENT DOCUMENTS 5,029,540 7/1991 Hisatake et al. ..... 112/102.5
5,481,992 1/1996 Fujimura ..... 112/102.5
5,499,589 3/1996 Kyuno et al. ..... 112/102.5

FOREIGN PATENT DOCUMENTS

A-64-37993 2/1989 Japan .

*Primary Examiner*—Peter Nerbun
*Attorney, Agent, or Firm*—Oliff & Berridge

[57] ABSTRACT

An apparatus for processing sets of sewing data each set of which is needed to control a sewing machine to sew, on a work sheet, a corresponding one of sewing patterns with a corresponding one of sewing threads, the each set of sewing data including a set of designating data designating the corresponding one sewing thread, the apparatus including a data obtaining device which obtains the sets of sewing data which are needed to control the sewing machine to sew the sewing patterns in a predetermined order, and a changing device for, when the sewing patterns include at least one overlapping-pattern group consisting of at least two overlapping patterns which overlap each other, changing the predetermined order to a changed order such that an order of sewing of the overlapping patterns in relation with each other in the predetermined order is maintained in the changed order and such that a number of sewing-thread changes needed to sew the sewing patterns in the changed order is smaller than a number of sewing-thread changes needed to sew the sewing patterns in the predetermined order.

29 Claims, 11 Drawing Sheets

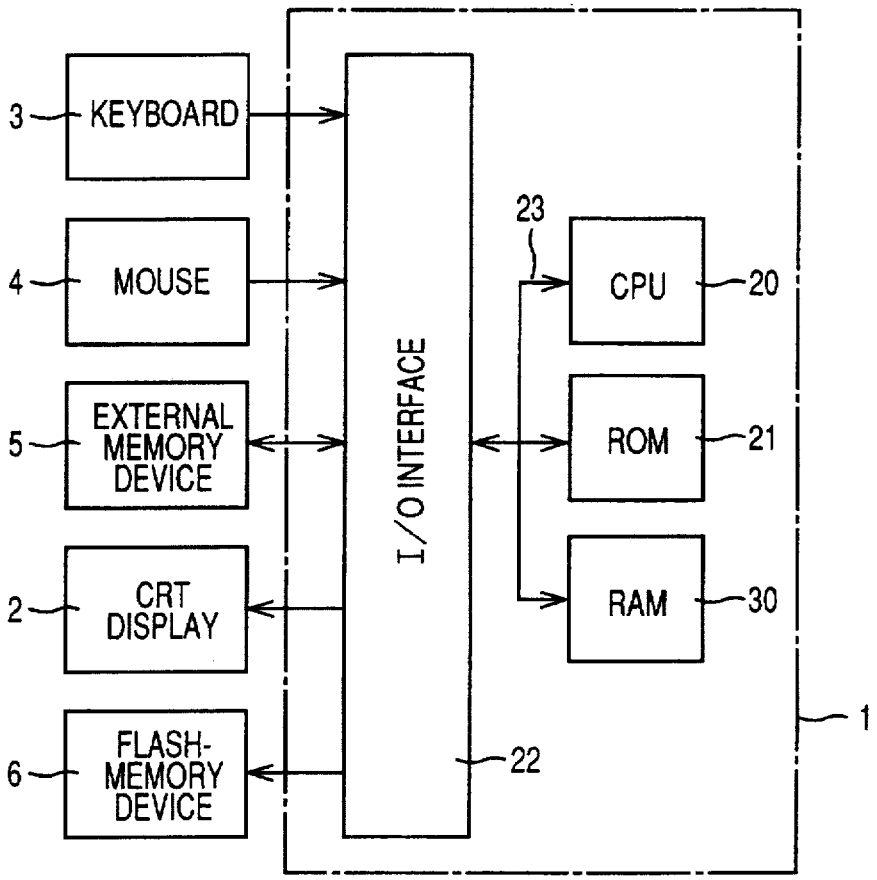
FIG. 2
FIG. 3
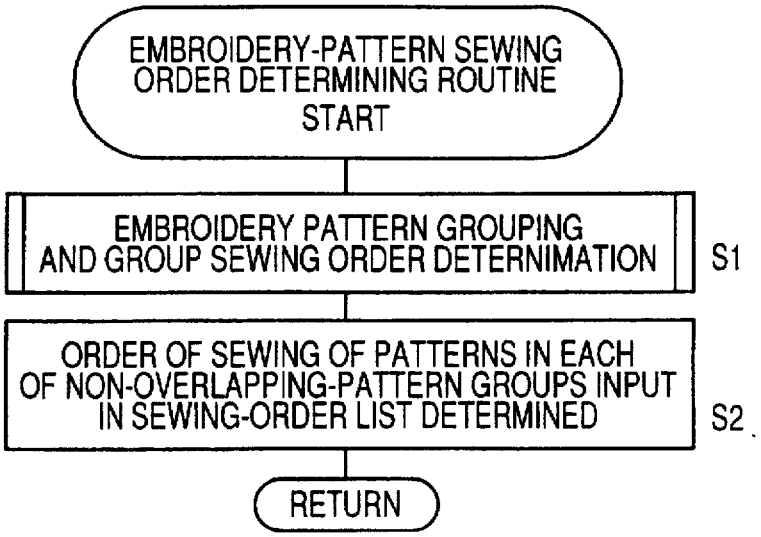

GREEN THREAD

RED THREAD

BLACK THREAD

OUTLINE OF UNDERLYING PORTION OF EMBROIDERY AREA b : BLACK
g : GREEN
r : RED
SEWING ORDER
FIRST
LAST
A (b)
B (g)
C (r)
D (b)
E (b)
F (g)
G (r)
H (b)
SEWING-THREAD CHANGES
1
2
3
4
5
6
INITIAL SEWING ORDER

A (b)
D (b)
E (b)
H (b)
B (g)
F (g)
C (r)
G (r)
SEWING-THREAD CHANGES
1
2
FIRST CHANGED SEWING ORDER

C (r)
A (b)
D (b)
E (b)
H (b)
B (g)
F (g)
G (r)
SEWING-THREAD CHANGES
1
2
3
SECOND CHANGED SEWING ORDER

GREEN THREAD

RED THREAD

BLACK THREAD

OUTLINE OF UNDERLYING PORTION OF EMBROIDERY AREA

EMBROIDERY PATTERNS

PATTERN GROUPS (UNDERLYING PATTERN OR GROUP) < (OVERLYING PATTERN OR GROUP)

EMBROIDERY DATA PROCESSING APPARATUS

BACKGROUND OF THE INVENTION

1. Field of the Invention

The present invention relates to an apparatus for processing sets of embroidery or sewing data indicative of respective embroidery or sewing patterns in a predetermined order, such that the predetermined order is changed.

2. Related Art Statement

There has been known an apparatus including a microcomputer for producing embroidery data with high quality in a short time. The data processing apparatus is provided by, e.g., a common personal computer to which a display, a mouse, a hard disk, etc. are connected. The display and the mouse may be used by a user to input a set of embroidery-area defining data which defines an outline of an embroidery area to be filled with stitches formed by a sewing machine. The display and the mouse may also be used by the user to input, according to instructions or messages indicated on the display, a set of stitching-manner data indicative of a stitching manner (e.g., satin stitching or seed stitching) in which stitches are formed to fill the embroidery area and thereby provide an embroidery pattern, and a set of sewing-thread designating data which designates a sewing thread having a particular color with which the embroidery stitches are formed. In the case where a plurality of sets of embroidery data each of which includes a set of embroidery-area defining data, a set of stitching manner data and a set of sewing-thread designating data are input to the data processing apparatus, the order of sewing of respective embroidery patterns corresponding to the sets of embroidery data is initially determined as being the same as the order of inputting of the sets of embroidery data. However, the data processing apparatus has the editing function of changing the initial sewing order to a different order.

In the case where a home-use sewing machine automatically sews a plurality of embroidery patterns according to the sets of embroidery data produced by the above data processing apparatus, the sewing machine must be stopped for the user to change the preceding one of two different sewing threads to the following, other sewing thread, if the two different sewing threads are designated by the respective sets of designating data of the two sets of sewing data which are consecutively used to control the sewing machine to consecutively sew the corresponding two sewing patterns. Meanwhile, the sewing machine continues to use a sewing thread while each sewing pattern is sewn, or when the sewing thread is commonly designated by the respective sets of designating data of the two sets of sewing data consecutively used to control the sewing machine. Sewing-thread changes must be carried out manually by the user and are very cumbersome and time-consuming. For example, in the case where eight embroidery patterns, A to H, shown in FIG. 5 are input in an order indicated in FIG. 6A, and the embroidery patterns A to H are sewn in the same order as the order of inputting thereof, six sewing-thread changes are needed during the sewing of the eight patterns A to H. Thus, it is desirable to change the initial sewing order to a different sewing order which needs only the smallest number of sewing-thread changes.

Japanese Patent Application laid open for inspection under Publication No. 64(1989)-37993 and U.S. Pat. No. 5,029,540 disclose a technique to solve the above-identified problem. The disclosed technique relates to the art of changing an initial sewing order to a changed sewing order in which a plurality of embroidery patterns to be sewn with a common sewing thread are consecutively sewn with the common sewing thread.

However, the above-indicated prior technique suffers from another problem that when embroidery patterns include one or more overlapping-pattern groups each of which consists of a plurality of overlapping patterns which overlap each other, the order of sewing of the overlapping patterns in relation with each other in an initial sewing order may not be maintained in a changed sewing order. Accordingly, a first overlapping pattern to be sewn under a second overlapping pattern in the initial order may be sewn over the second overlapping pattern in the changed order, against user's intention. If the prior technique is applied to the embroidery patterns A to H shown in FIG. 5, the initial sewing order indicated in FIG. 6A is changed to a first changed sewing order indicated in FIG. 6B in which the overlapping pattern C to be sewn under the overlapping pattern D in the initial order is sewn over the overlapping pattern D in the first changed order, as shown in FIG. 7.

SUMMARY OF THE INVENTION

It is therefore an object of the present invention to provide a sewing data processing apparatus which advantageously changes the order of sewing of sewing patterns irrespective of whether the sewing patterns include overlapping patterns which overlap each other.

The above object has been achieved according to a first aspect of the present invention, which provides an apparatus for processing a plurality of sets of sewing data each set of which is needed to control a sewing machine to sew, on a work sheet, a corresponding one of a plurality of sewing patterns with a corresponding one of a plurality of sewing threads, the each set of sewing data including a set of designating data designating said corresponding one sewing thread, the apparatus comprising a data obtaining device which obtains the sets of sewing data which are needed to control the sewing machine to sew the sewing patterns in a predetermined order, and changing means for, when the sewing patterns include at least one overlapping-pattern group consisting of a plurality of overlapping patterns which overlap each other, changing the predetermined order to a changed order such that an order of sewing of the overlapping patterns in relation with each other in the predetermined order is maintained in the changed order and such that a number of sewing-thread changes needed to sew the sewing patterns in the changed order is smaller than a number of sewing-thread changes needed to sew the sewing patterns in the predetermined order. The sewing machine is stopped to change the preceding one of two different sewing threads to the following, other sewing thread, when the two different sewing threads are designated by the respective sets of designating data of the two sets of sewing data which are consecutively used to control the sewing machine to consecutively sew the corresponding two sewing patterns, and the sewing machine continues to use a sewing thread when the sewing thread is commonly designated by the respective sets of designating data of the two sets of sewing data consecutively used to control the sewing machine.

In the sewing-data processing apparatus in accordance with the first aspect of the invention, the changing means changes, without changing an order of sewing of the overlapping patterns in relation with each other in the predetermined order, the predetermined order to a changed order such that a number of sewing-thread changes needed to sew the sewing patterns in the changed order is smaller than a number of sewing-thread changes needed to sew the sewing patterns in the predetermined order. Thus, a first overlapping pattern to be sewn under a second overlapping pattern in the predetermined order is not sewn over the second overlapping pattern in the changed order, against user's intention.

According to a preferred feature of the first aspect of the invention, the changing means comprises means for, when the sewing patterns do not include the overlapping-pattern group, changing the predetermined order to the changed order in which at least two of the sewing patterns corresponding to at least two sets of sewing data including respective sets of designating data commonly designating each of the sewing threads, are consecutively sewn with the each sewing thread by the sewing machine.

According to another feature of the first aspect of the invention, the sewing-data processing apparatus further comprises searching means for searching the sewing patterns for finding the overlapping-pattern group. Otherwise, the overlapping-pattern group may be specified or selected by the user who sees and designates each of the overlapping patterns of the overlapping-pattern group being displayed on a screen of a display device of the processing apparatus, by using a pointer which is movable on the screen under control of a mouse connected to the display device.

According to another feature of the first aspect of the invention, the searching means comprises means for finding the overlapping-pattern group consisting of the overlapping patterns which actually overlap each other in a two-dimensional coordinate system corresponding to the work sheet. Alternatively, the searching means may comprise means for finding the overlapping-pattern group consisting of the overlapping patterns having respective circumscribing rectangles which overlap each other in a two-dimensional coordinate system corresponding to the work sheet. Each of the circumscribing rectangles may have a first pair of sides parallel to one of two axes of a two-dimensional orthogonal coordinate system, and a second pair of sides parallel to the other axis of the coordinate system.

According to another feature of the first aspect of the invention, the changing means comprises means for changing the predetermined order to the changed order such that a number of the sewing patterns which correspond to sets of sewing data including respective sets of designating data commonly designating one of the sewing threads and which are consecutively sewn with the one sewing thread in the changed order, is greater than a number of the sewing patterns which correspond to sets of sewing data including respective sets of designating data commonly designating the one sewing thread and which are consecutively sewn with the one sewing thread in the predetermined order.

According to another feature of the first aspect of the invention, the changing means comprises means for changing the predetermined order to the changed order such that a number of the sewing patterns which correspond to sets of sewing data including respective sets of designating data commonly designating each of at least two of the sewing threads and which are consecutively sewn with the each sewing thread in the changed order, is greater than a number of the sewing patterns which correspond to sets of sewing data including respective sets of designating data commonly designating the each sewing thread and which are consecutively sewn with the each sewing thread in the predetermined order.

According to another feature of the first aspect of the invention, the changing means comprises means for changing the predetermined order to the changed order such that a sum of each number of the sewing patterns which correspond to sets of sewing data including respective sets of designating data commonly designating each of the sewing threads and which are consecutively sewn with the each sewing thread in the changed order, is greater than a sum of each number of the sewing patterns which correspond to sets of sewing data including respective sets of designating data commonly designating the each sewing thread and which are consecutively sewn with the each sewing thread in the predetermined order. That is, the sum of respective numbers of sewing patterns in the changed order each number of which means a number of the sewing patterns consecutively sewn with a corresponding one of the sewing threads, is greater than the sum of respective numbers of sewing patterns in the predetermined order each number of which means a number of the sewing patterns consecutively sewn with a corresponding one of the sewing threads.

According to another feature of the first aspect of the invention, the changing means comprises means for changing the predetermined order to the changed order such that a sum of each number of the sewing patterns which correspond to sets of sewing data including respective sets of designating data commonly designating each of the sewing threads and which are consecutively sewn with the each sewing thread in the changed order takes as great as possible a number. That is, the sum of respective numbers of sewing patterns in the changed number each number of which means a number of the sewing patterns consecutively sewn with a corresponding one of the sewing threads takes as great as possible a number. For example, subject to the condition that the order of sewing of the overlapping patterns in relation with each other in the predetermined order is maintained in a changed sewing order, the changing means may determine all possible changed sewing orders, calculate the above-described sum of respective numbers of sewing patterns with respect to each of the possible changed orders, and select the greatest one of all the calculated sums.

According to another feature of the first aspect of the invention, the changing means comprises searching means for searching the sewing patterns for finding a first non-overlapping-pattern group consisting of a plurality of non-overlapping patterns which correspond to at least two sets of sewing data including respective sets of designating data commonly designating a first one of the sewing threads and which do not overlap each other, and the changing means changes the predetermined order to the changed order in which the non-overlapping patterns of the first non-overlapping-pattern group are consecutively sewn with the first sewing thread. Thus, the number of sewing-thread changes needed to sew the sewing patterns in the changed order is decreased.

According to another feature of the first aspect of the invention, the changing means further comprises data-modifying means for regarding the non-overlapping patterns of the first non-overlapping-pattern group as a single pattern with respect to the remaining patterns of the sewing patterns, and regarding at least one of the remaining patterns which overlaps at least one of the non-overlapping patterns of the first non-overlapping-pattern group, as overlapping the single pattern such that the one remaining pattern precedes the single pattern in the changed order when the one remaining pattern precedes the one non-overlapping pattern in the predetermined order and such that the one remaining pattern follows the single pattern in the changed order when the one remaining pattern follows the one non-overlapping pattern in the predetermined order, the searching means searches the single pattern and the remaining patterns for finding a second non-overlapping-pattern group consisting of a plurality of non-overlapping patterns which correspond to at least two sets of sewing data including respective sets of designating data commonly designating a second one of the sewing threads and which do not overlap each over, and the changing means changes the predetermined order to the changed order in which the non-overlapping patterns of the second non-overlapping-pattern group are consecutively sewn with the second sewing thread.

According to another feature of the first aspect of the invention, the changing means further comprises repeating means for repeating respective operations of the searching means and the data-modifying means until the searching means finds no non-overlapping-pattern group consisting of a plurality of non-overlapping patterns which correspond to at least two sets of sewing data including respective sets of designating data commonly designating any one of the sewing threads and which do not overlap each over.

According to another feature of the first aspect of the invention, the changing means further comprises selecting means for, when the searching means finds a plurality of non-overlapping-pattern groups, selecting, as the first non-overlapping-pattern group, one of the plurality of non-overlapping-pattern groups which consists of a greatest number of the non-overlapping patterns in the plurality of non-overlapping-pattern groups. Thus, the number of sewing-thread changes needed to sew the sewing patterns in the changed order is effectively decreased.

According to another feature of the first aspect of the invention, the searching means comprises means for regarding, as a single pattern, at least two overlapping patterns of the overlapping-pattern group which correspond to at least two sets of sewing data including respective sets of designating data commonly designating one or each of the sewing threads and which are consecutively sewn with the one or each sewing thread in the predetermined order.

According to another feature of the first aspect of the invention, the data obtaining device comprises means for obtaining, as the sets of sewing data, a plurality of sets of embroidery data each of which consists of a set of sewing-thread designating data designating a corresponding one of the sewing threads, and a set of embroidery-area defining data defining, in a two-dimensional coordinate system corresponding to the work sheet, an embroidery area which is filled with stitches formed by the sewing machine. The set of embroidery-are defining data may comprise a set of outline data defining an outline of an embroidery area, or a set of dot data defining an inside area of an embroidery area. The set of outline data may comprise sets of position data defining positions or points on the outline of the embroider area.

According to another feature of the first aspect of the invention, the data obtaining device comprises means for obtaining, as the sets of sewing data, a plurality of sets of embroidery data each of which includes a set of sewing-thread designating data designating a corresponding one of the sewing threads, and sets of stitch-position defining data defining, in a two-dimensional coordinate system corresponding to the work sheet, respective stitch positions at which stitches are formed by the sewing machine.

According to another feature of the first aspect of the invention, the data obtaining device comprises a data input device which is operable for inputting the sets of sewing data indicative of the sewing patterns in the predetermined order.

According to another feature of the first aspect of the invention, the data obtaining device comprises a data reading device which reads, from an external data memory, the sets of sewing data indicative of the sewing patterns in the predetermined order.

According to another feature of the first aspect of the invention, the sewing-data processing apparatus further comprises a utilizing device which utilizes the sets of sewing data indicative of the sewing patterns in the changed order to control the sewing machine to sew the sewing patterns in the changed order on the work sheet.

According to another feature of the first aspect of the invention, the utilizing device comprises a stitch-forming device of the sewing machine which forms stitches of each of the sewing patterns in the changed order on the work sheet.

According to another feature of the first aspect of the invention, the utilizing device comprises a stopping device of the sewing machine which stops a stitch-forming operation of a stitch-forming device of the sewing machine to change a preceding one of two different sewing threads to the following, other sewing thread when the two different sewing threads are designated by the respective sets of designating data of the two sets of sewing data which are consecutively used to control the sewing machine to consecutively sew the corresponding two sewing patterns on the work sheet.

According to another feature of the first aspect of the invention, the utilizing device comprises a data recording device which records, in an external data memory, the sets of sewing data indicative of the sewing patterns in the changed order to control the sewing machine to sew the sewing patterns in the changed order on the work sheet.

According to a second aspect of the present invention, there is provided an apparatus for processing a plurality of sets of sewing data each set of which is needed to control a sewing machine to sew, on a work sheet, a corresponding one of a plurality of sewing patterns with a corresponding one of a plurality of sewing threads, the each set of sewing data including a set of designating data designating the corresponding one sewing thread, the apparatus comprising a data obtaining device which obtains the sets of sewing data which are used to control the sewing machine to sew the sewing patterns in a predetermined order, and changing means for, when the sewing patterns includes no overlapping-pattern group consisting of a plurality of overlapping patterns which overlap each other, changing the predetermined order to a changed order in which at least two of the sewing patterns corresponding to at least two sets of sewing data including respective sets of designating data commonly designating each of the sewing threads, are consecutively sewn with the each sewing thread by the sewing machine.

In the sewing-data processing apparatus in accordance with the second aspect of the invention, the changing means changes the predetermined order to a changed order in which two or more sewing patterns corresponding to two or more sets of sewing data including respective sets of designating data commonly designating each of the sewing threads, are consecutively sewn with the each sewing thread by the sewing machine. Therefore, the number of sewing-thread changes needed to sew the sewing patterns in the changed order is decreased.

According to a preferred feature of the second aspect of the invention, the sewing-data processing apparatus further comprises searching means for searching the sewing patterns for finding the overlapping-pattern group.

According to another feature of the second aspect of the invention, the sewing-data processing apparatus further comprises a utilizing device which utilizes the sets of sewing data indicative of the sewing patterns in the changed order to control the sewing machine to sew the sewing patterns in the changed order on the work sheet.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which:

FIG. 2 is a diagrammatic view of an electric construction of the data processing apparatus of FIG. 1;

FIG. 3 is a flow chart representing an embroidery-pattern sewing order determining routine as one of control programs stored in a read only memory (ROM) of a control device of the data processing apparatus shown in FIG. 2;

DETAILED DESCRIPTION OF THE PREFERRED EMBODIMENTS

Figure 1:
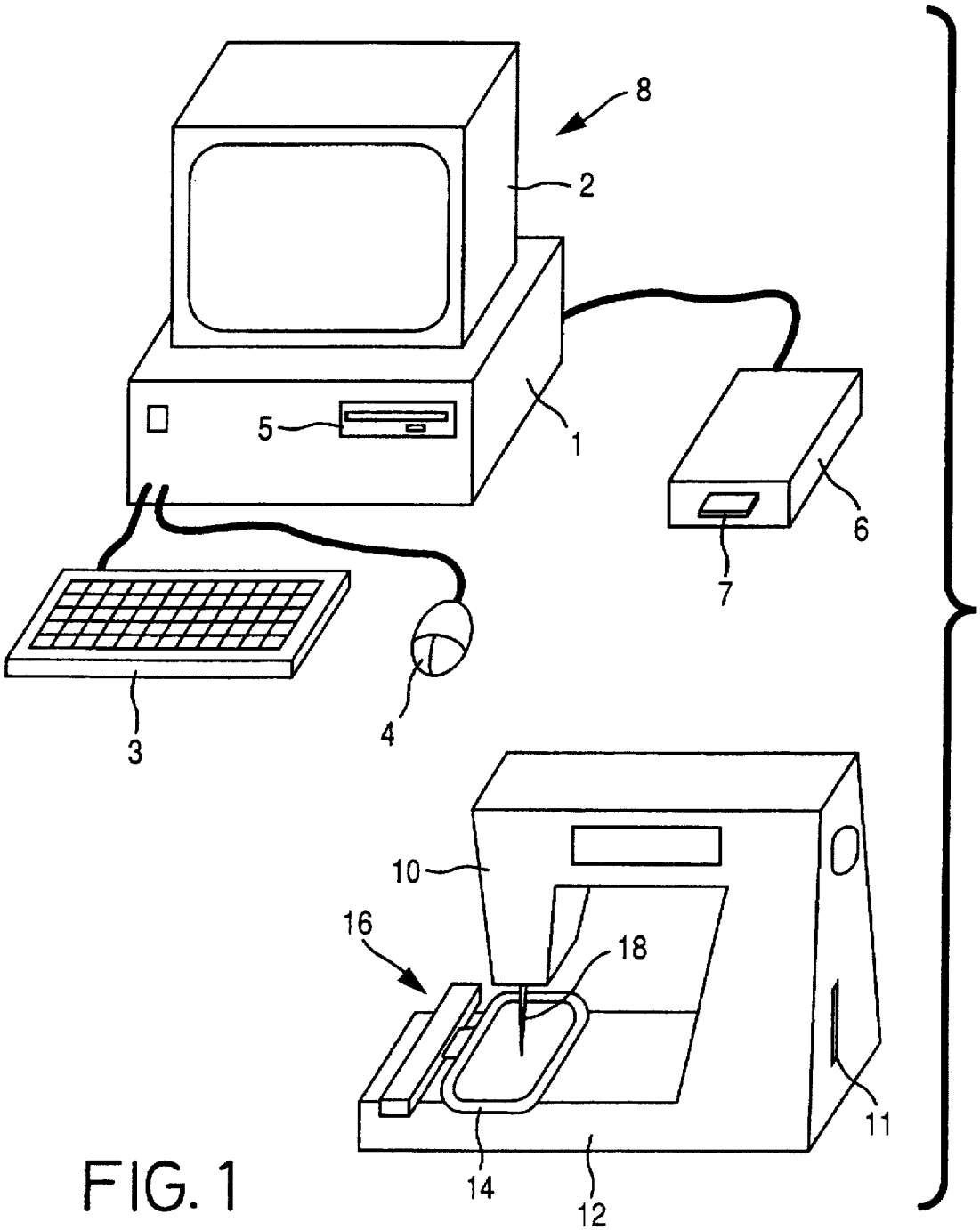
FIG. 1 is a perspective view of an embroidery-data processing apparatus and a sewing machine to which the present invention is applied.

Referring first to FIG. 1, there is shown an embroidery data processing apparatus 8 to which the present invention is applied. The data processing apparatus 8 processes sets of embroidery data which are supplied to a home-use sewing machine 10. The data processing apparatus 8 is essentially provided by a personal computer system including an input device, i.e., a keyboard 3 and a mouse 4 which are manually operable by a user for inputting sets of embroidery-area defining data each of which defines, in an x-y orthogonal coordinate system prescribed for the sewing machine 10, an embroidery area to be filled with stitches formed by the sewing machine 10. The data processing apparatus 8 produces, based on the sets of embroidery-area defining data, sets of embroidery data each of which includes sets of stitch-position data indicative of stitch positions (i.e., x and y coordinates) at which a sewing needle 18 of the sewing machine 10 penetrates a work sheet (not shown). The sets of embroidery data produced by the data processing apparatus 8 are recorded on a flash-memory card 7 which can be removed from a first flash-memory device 6 of the processing device 8 and can be inserted in a second flash-memory device 11 of the sewing machine 10.

As shown in FIG. 1, the data processing apparatus 8 basically includes a control device 1; a CRT (cathode ray tube) display 2; the keyboard 3 and the mouse 4; an external memory device 5; and the first flash-memory device 6. The CRT display 2 displays, on a screen thereof, characters and images (e.g., embroidery areas, A to H, shown in FIG. 5). The keyboard 3 and/or the mouse 4 are/is operable for inputting, as each set of embroidery-area defining data, x and y coordinates defining an embroidery area, and for selecting an appropriate operation mode on the data processing apparatus 8. The external memory device 5 records or writes, in an external data memory such as a floppy disk, sets of embroidery-area defining data input through the keyboard 3 and/or the mouse 4, and reads, from the external data memory, sets of embroidery-area defining data recorded thereon. The first flash-memory device 6 records sets of embroidery data indicative of respective embroidery patterns in a sewing order, in the flash-memory card 7 which can be inserted therein, and removed therefrom. The CRT display 2, keyboard 3, mouse 4, external memory device 5, and first flash-memory device 6 are connected to the control device 1.

The home-use sewing machine 10 includes a sewing bed 12; a work-sheet holder 14 for holding a work sheet (not shown) on which embroidery patterns are formed in a sewing order; a moving device 16 which moves the work-sheet holder 14 in a horizontal plane, i.e., x-y coordinate system prescribed for the sewing machine 10; and the sewing needle 18 and a shuttle or hook (not shown) which cooperate with each other to form stitches to fill embroidery areas and thereby provide embroidery patterns on the work sheet. The sewing machine 10 further includes a control device (e.g., microcomputer, not shown) which controls the operation of the moving device 16 and the vertical movement of a needle bar to which the sewing needle 18 is secured. According to each set of stitch-position data indicative of a stitch position, i.e., respective movement amounts of the work-sheet holder 14 in the x and y directions, the control device automatically operates the moving device 16 to move the holder 14 to the stitch position while simultaneously operating the sewing needle 18 and the shuttle to form a stitch at the stitch position.

In addition to the sets of stitch-position data, each set of embroidery data includes a set of sewing-thread designating data designating a sewing thread having a particular color. In the case where two different sewing threads having different colors are designated by the respective sets of sewing-thread designating data of two sets of embroidery data corresponding to two embroidery patterns which are consecutively sewn in a sewing order by the sewing machine 10, the control device stops the sewing operation of the sewing machine 10 so that the user can change the preceding one of the two sewing threads to the following, other sewing thread on the sewing machine 10.

The sewing machine 10 has the second flash-memory device 11 which reads the sets of embroidery data from the flash-memory card 7 being inserted therein. The present data processing apparatus 8 has the function of processing those sets of embroidery data.

As shown in FIG. 2, the control device 1 of the data processing apparatus 8 includes an input and output (I/O) interface 22, a central processing unit 20, a read only memory 21, a random access memory 30, and a bus 23 (e.g., data bus) connecting the elements 22, 20, 21, 30 to one another. The CRT display 2, keyboard 3, mouse 4, external memory device 5, and first flash-memory device 6 are connected to the I/O interface 22. The ROM 21 stores various control programs including an embroidery-pattern sewing order determining routine represented by the flow charts of FIGS. 3 and 4 which will be described below.

Hereinafter, there will be described the operation of the control device 1 of the data processing apparatus 8 for processing sets of embroidery data according to the embroidery-pattern sewing order determining routine, by reference to the flow charts of FIGS. 3 and 4.

As far as the present embodiment is concerned, initially, each set of embroidery data includes a set of embroidery-area defining data defining an outline of an embroidery area to be filled with stitches (e.g., area, A to H, shown in FIG. 5), a set of stitching-method data indicative of a stitching manner (e.g., satin stitching or seed stitching), a direction of formation of stitches relative to the x or y direction, a stitch density (e.g., numbers of stitches formed in unit length, or number of stitches formed in each of divided blocks of an embroidery area), etc., and a set of sewing-thread designating data designating a sewing thread having a particular color with which stitches are formed to fill the embroidery area.

Figure 5:
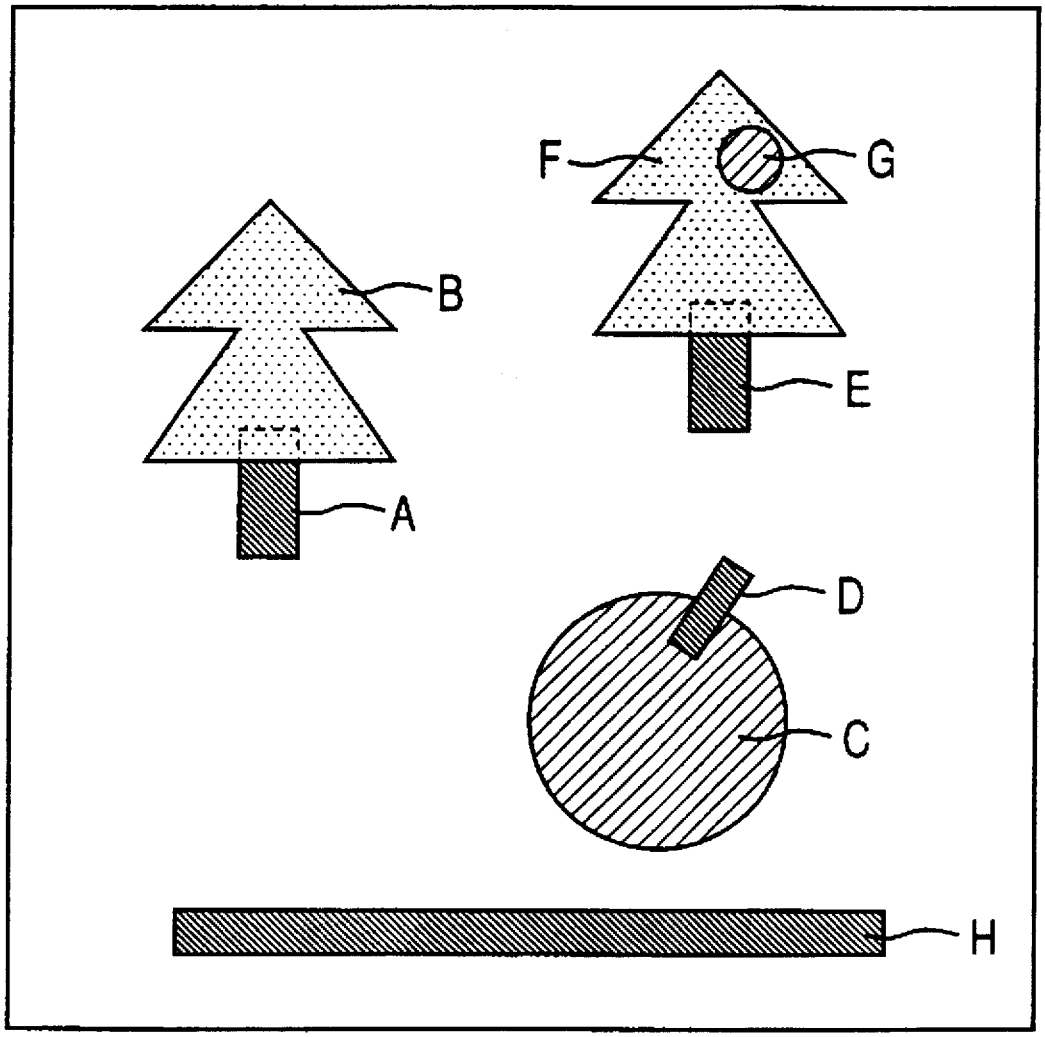
FIG. 5 is a view of respective embroidery areas of embroidery patterns which are input to, or read by, the data processing apparatus of FIG. 1.
Figures 6A, 6B, 6C:
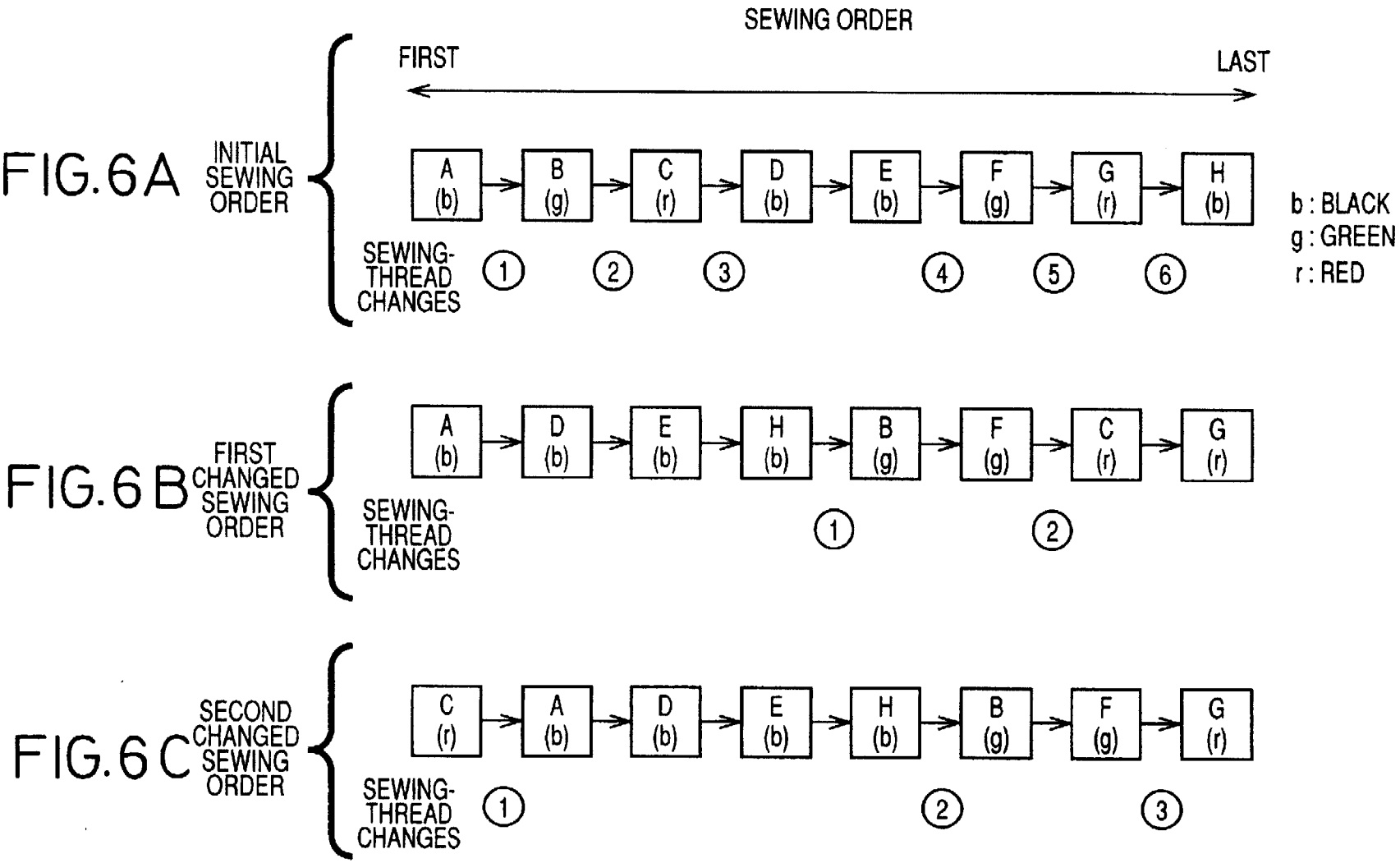
FIG. 6A is a view of the embroidery patterns of FIG. 5 that are arranged in an initial sewing order.
FIG. 6B is a view of the embroidery patterns of FIG. 5 that are arranged in a first changed sewing order.
FIG. 6C is a view of the embroidery patterns of FIG. 5 that are arranged in a second changed sewing order.
Figure 7:
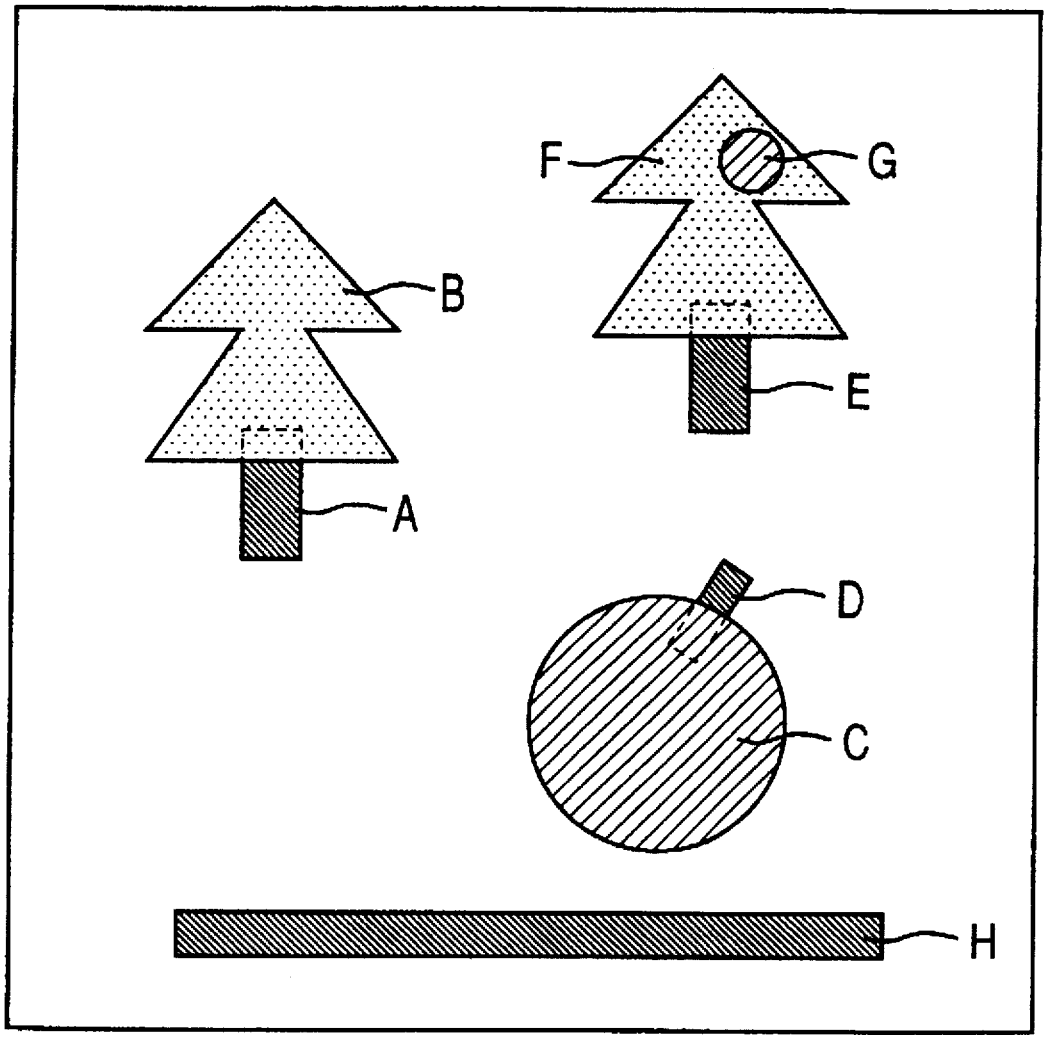
FIG. 7 is a view of the embroidery patterns of FIG. 5 that are sewn in the first changed sewing order indicated in FIG. 6B.

When the control device 1 begins with the routine of FIG. 3 for, e.g., a series of embroidery areas A to H shown in FIG. 5, sets of embroidery data indicative of the embroidery areas or patterns A to H in the sewing order indicated in FIG. 6A, are stored in the RAM 30. The control device 1 may obtain the sets of embroidery data input by the user through the keyboard 3 and/or the mouse 4, or the sets of embroidery data read from the external data memory (e.g., floppy disk) through the external memory device 5. The embroidery areas A to H are displayed on the screen of the CRT display 2, as shown in FIG. 5.

Figure 4:
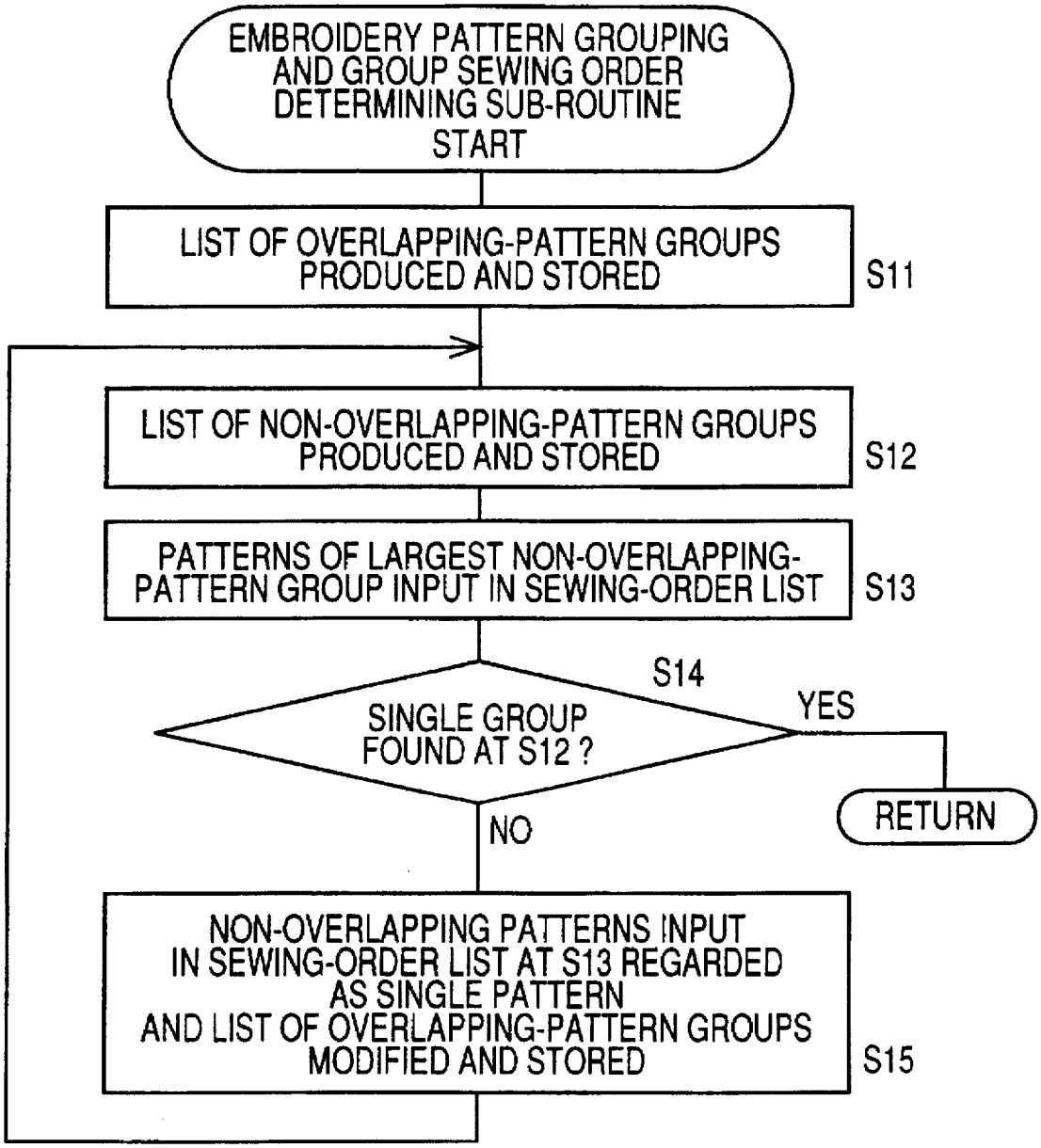
FIG. 4 is a flow chart representing an embroidery-pattern grouping and group-sewing-order determining routine as a sub-routine of the main routine of FIG. 3.

Upon operation of a start key (not shown) on the keyboard 3, the CPU 20 of the control device 1 starts with Step S1 of the flow chart of FIG. 3, i.e., embroidery-pattern grouping and group-sewing-order determining sub-routine represented by the flow chart of FIG. 4.

Figure 8A:
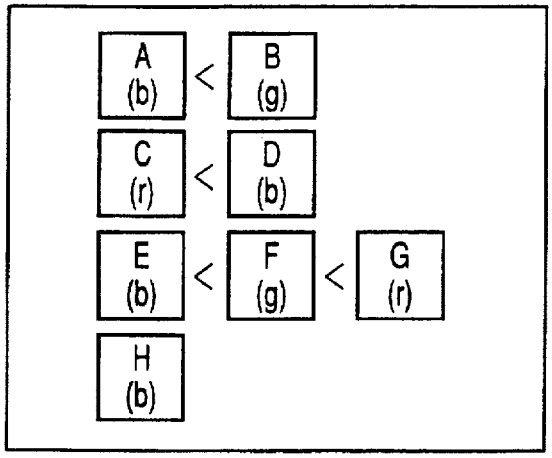
FIG. 8A is a view of overlapping-pattern groups searched or found in the embroidery patterns of FIG. 5.

At Step S11, the CPU 20 of the control device 1 searches the embroidery patterns A to H for finding one or more overlapping-pattern groups each of which consists of a plurality of overlapping patterns which overlap each other. As far as the present embodiment is concerned, a single pattern which does not overlap any other pattern is regarded as an overlapping-pattern group. In addition, regarding each overlapping-pattern group consisting of a plurality of overlapping patterns, the CPU 20 determines the order of sewing of the overlapping patterns in relation with each other in the initial sewing order shown in FIG. 6A. Thus, the CPU 20 provides a list of overlapping-pattern groups as shown in FIG. 8A.

More specifically,the CPU 20 searches the embroidery patterns A to H for finding an overlapping-pattern group consisting of a plurality of overlapping patterns which actually overlap each other in the x-y coordinate system prescribed for the sewing machine 10. Two patterns can actually overlap each other in one of the following two manners:

(1) the overlying one of the two patterns partially overlies on the underlying, other pattern, and (2) the overlying one of the two patterns completely overlies on the underlying, other pattern.

Figure 10A:
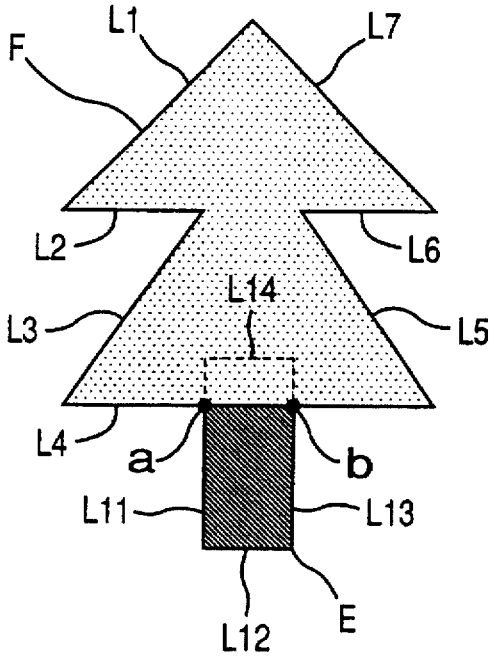
FIG. 10A is a view illustrating the manner of finding an overlapping one of two overlapping patterns which partially overlaps the underlying, other pattern.

The above first case (1) is identified by judging whether the respective outlines of two embroidery patterns or areas have one or more intersections, i.e., the respective equations representing the two outlines have one or more common solutions. For example, as shown in FIG. 10A, the outline of the embroidery pattern or area F consists of line segments, L1 to L7, and the outline of the embroidery area E consists of line segments, L11 to L14. Since the two outlines have intersections, a and b, the CPU 20 judges that the two areas or patterns E, F are overlapping patterns which overlap each other.

Figure 10B:
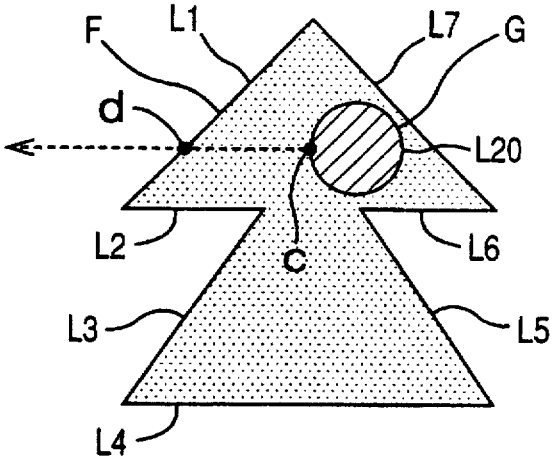
FIG. 10B is a view illustrating the manner of finding overlapping patterns an overlying one of which completely overlies on the other, underlying pattern.

If the respective outlines of two embroidery areas are judged as having no intersection, then it can be concluded that the two areas are completely separate from each other or one of the two areas is completely contained in the other area. If a half line is drawn from an arbitrary point on the outline of a first area completely contained in a second area, the half line and the outline of the second area have an odd number of intersection or intersections. Otherwise, a half line drawn from an arbitrary point on the outline of a first area and the outline of a second area have no intersection, or an even number of intersections. In this way, the above-described second case (2) is identified. For example, as shown in FIG. 10B, the outline of the embroidery area F consists of the line segments L1 to L7, and the outline of the embroidery area G consists of a circle, L20. The respective outlines of the two areas F, G have no intersection. If a half line is drawn from an arbitrary point, c, on the outline L20 of the area G completely contained in, or overlying on, the area F, the half line and the outline of the area F have a single intersection, d. Thus, the CPU 20 judges that the area G completely overlies the area F, i.e., that the areas F, G are overlapping areas or patterns which overlap each other. Therefore, the CPU 20 identifies that the three patterns E, F, G are overlapping patterns which overlap one another and which provides an overlapping-pattern group.

In addition, the CPU 20 determines, based on the initial sewing order shown in FIG. 6A, the order of sewing of the three overlapping patterns E, F, G in relation with one another in the initial sewing order such that (pattern E)< (pattern F)<(pattern G), where the left-hand side pattern of symbol "<" precedes the right-hand side pattern in a sewing order. That is, the CPU 20 identifies that the pattern E is the bottom pattern, the pattern F is the intermediate pattern, and the pattern G is the top pattern.

When Step S11 is completed, the CPU 20 provides the list of four overlapping-pattern groups shown in FIG. 8A. Each one of the four overlapping-pattern groups includes no pattern which overlaps the patterns of the other groups. The first group consists of the patterns A, B (A<B); the second group consists of the patterns C, D (C<D); the third group consists of the patterns E, F, G (E<F<G); and the fourth group consists of the single pattern H. The overlapping-pattern-group list shown in FIG. 8A is stored in the RAM 30.

Figure 9A:
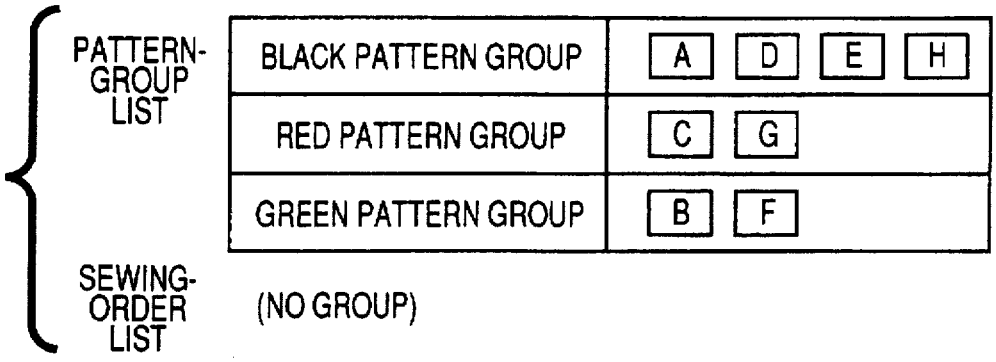
FIG. 9A is a view of a pattern-group list and a sewing-order list based on which the largest non-overlapping-pattern group of FIG. 8B is found in the embroidery patterns of FIG. 5.

Step S11 is followed by Step S12 to search the overlapping-pattern-group list of FIG. 8A, i.e., the remaining patterns other than the patterns which have been input in a sewing-order list, for finding one or more non-overlapping-pattern groups each of which consists of a plurality of non-overlapping patterns which correspond to a plurality of sets of embroidery data including respective sets of designating data commonly designating a particular sewing thread having a particular color and which do not overlap each other. As far as the present embodiment is concerned, two or more overlapping patterns which correspond to a common sewing thread having a particular color and which overlap each other are grouped into two or more different non-overlapping-pattern groups, respectively, each of which consists of a single pattern. In the first control cycle according to the flow chart of FIG. 4, the sewing-order list has no pattern as shown in FIG. 9A. Accordingly, the CPU 20 searches all the patterns A to H and finds three non-overlapping-pattern groups corresponding to a black, a read, and a green sewing thread, respectively. Since the four patterns A, D, E, H corresponding to the black sewing thread do not overlap one another as shown in the list of FIG. 8A, the four patterns are grouped into a single non-overlapping-pattern group. Similarly, the two patterns C, G corresponding to the red sewing thread do not overlap each other, and are grouped into a single non-overlapping-pattern group; and the two patterns B, F corresponding to the green sewing thread do not overlap each other, and are grouped into a single non-overlapping-pattern group.

Figure 9B:
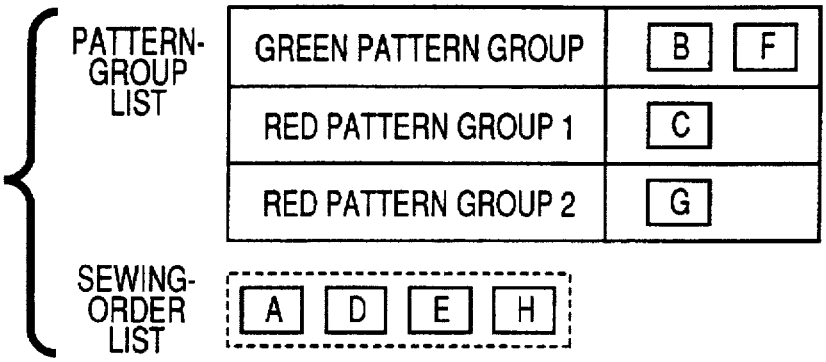
FIG. 9B is a view of a pattern-group list and a sewing-order list based on which the currently largest non-overlapping-pattern group of FIG. 8C is found in the remaining patterns.

Step S12 is followed by Step S13 to input, in the sewing-order list, the non-overlapping patterns of the largest non-overlapping-pattern group which consists of the greatest number of non-overlapping patterns of all the non-overlapping-pattern groups found in Step S12. Since the group corresponding to the black thread is the largest group, the patterns A, D, E, H of the black-thread group is are input in the sewing-order list as shown in FIG. 9B.

Step S13 is followed by Step S14 to judge whether only a single non-overlapping-pattern group has been identified at Step S12. If a negative judgment is made at Step S14, the control of the CPU 20 goes to Step S15 to modify the sets of embroidery data by regarding the non-overlapping patterns A, D, E, H input in the sewing-order list at Step S13, as a single pattern with respect to the remaining patterns C, G, B, F, and regarding each remaining pattern which overlaps any one of the non-overlapping patterns input in the sewing-order list, as overlapping the single pattern such that the each remaining pattern precedes the single pattern in a changed sewing order if the each remaining pattern precedes the one non-overlapping pattern in the initial sewing order and such that the each remaining pattern follows the single pattern in the changed order if the each remaining pattern follows the one non-overlapping pattern in the initial sewing order. In addition, the same operation as carried out at Step S11 is applied to the single pattern and the remaining patterns, for producing a new list of overlapping-pattern groups shown in FIG. 8B.

Figure 8B:
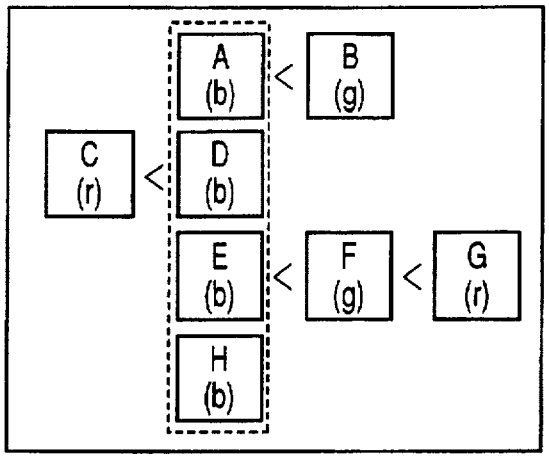
FIG. 8B is a view of the currently largest non-overlapping-pattern group found in the embroidery patterns of FIG. 5 so that the non-overlapping patterns of the largest group are consecutively sewn with a corresponding common sewing thread by the sewing machine of FIG. 1.

Following Step S15, the control of the CPU 20 returns to Step S12 to search the overlapping-pattern-group list of FIG. 8B, i.e., the remaining patterns C, B, F, B for finding one or more non-overlapping-pattern groups. Thus, the CPU 20 provides a list of three non-overlapping-pattern groups shown in FIG. 9B. As shown in FIG. 8B, since the two patterns B, F corresponding to the green thread do not overlap each other, the two patterns are grouped into a single group. However, since the two patterns C, G corresponding to the red thread overlap each other via the patterns A, D, E, H regarded as the single pattern, the two patterns are grouped into two separate groups, respectively, which consists of only a single pattern.

Figure 9C:
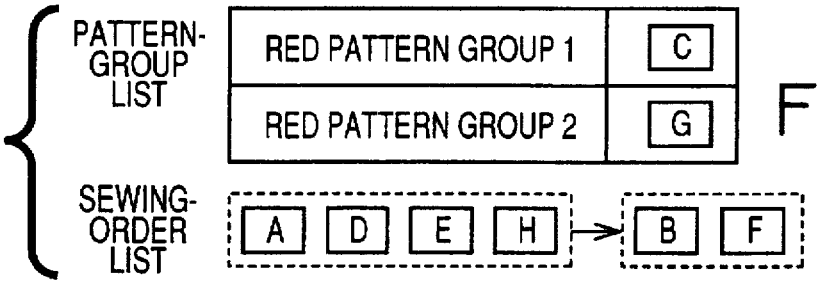
FIG. 9C is a view of a pattern-group list and a sewing-order list based on which the currently largest non-overlapping-pattern group of FIG. 8D is found in the remaining patterns.

The control of the CPU 20 goes again to Step S13 to input, in the sewing-order list, the patterns B, F of the green-thread group that currently is the largest group. As shown in FIG. 8B, since the patterns B, F follow the patterns A, D, E, H regarded as the single pattern, the patterns B, F are input in the sewing-order list such that the patterns B, F of the green-thread group follows the patterns A, D, E, H of the black-thread group, as shown in FIG. 9C.

Figure 8C:
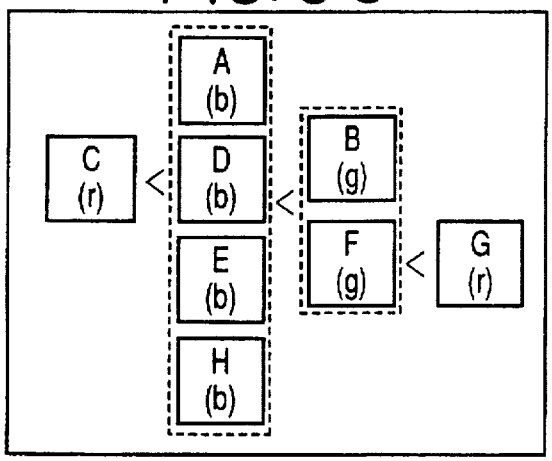
FIG. 8C is a view of the currently largest non-overlapping-pattern group found in the remaining patterns other than the patterns input in a sewing-order list.

Since the three groups are identified at Step S12 and a negative judgment is made at Step S14, the control goes to Step S15 to regard the non-overlapping patterns B, F input in the sewing-order list at Step S13, as a second single pattern with respect to the remaining patterns C, G and regard each remaining pattern which overlaps any one of the non-overlapping patterns input in the sewing-order list, as overlapping the second single pattern such that the each remaining pattern precedes the single pattern in the changed sewing order if the each remaining pattern precedes the one non-overlapping pattern in the initial sewing order and such that the each remaining pattern follows the single pattern in the changed order if the each remaining pattern follows the one non-overlapping pattern in the initial sewing order. In addition, the same operation as carried out at Step S11 is applied to the two single patterns and the remaining patterns C, G, for producing a new list of overlapping-pattern groups shown in FIG. 8C. Then, the control returns to Step S12.

Figure 8D:
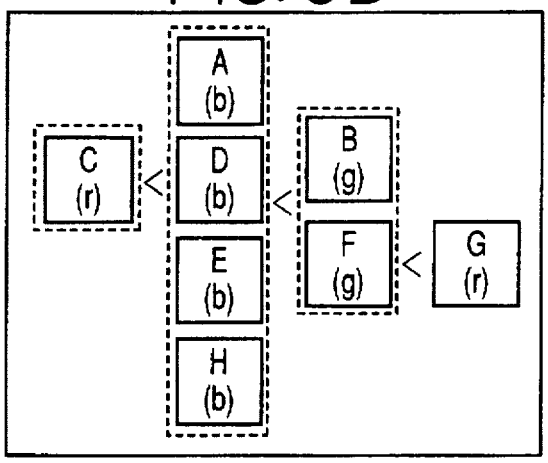
FIG. 8D is a view of the currently largest non-overlapping-pattern group (i.e., single pattern, C, in this example) found in the remaining patterns.
Figure 8E:
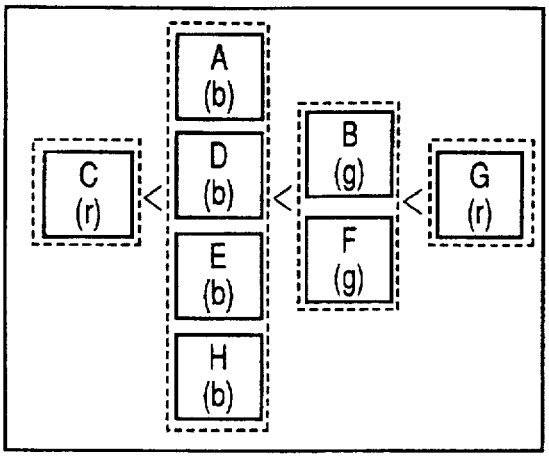
FIG. 8E is a view of the currently largest non-overlapping-pattern group (i.e., single pattern, G, in this example) found in the remaining patterns.
Figure 8E:
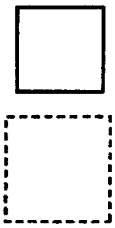
Figure 9D:
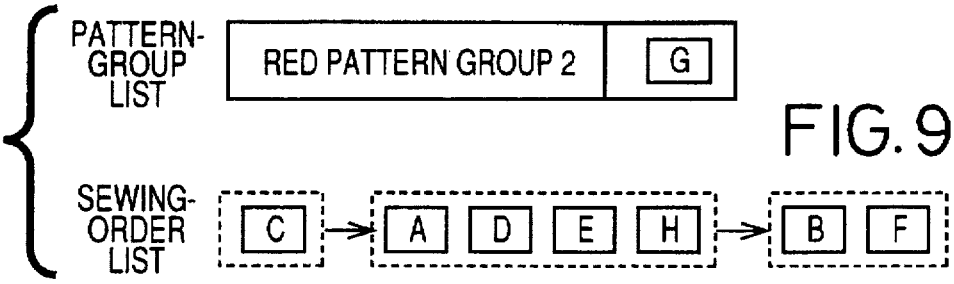
FIG. 9D is a view of a pattern-group list and a sewing-order list based on which the currently largest non-overlapping-pattern group of FIG. 8E is found in the remaining patterns.
Figure 9E:
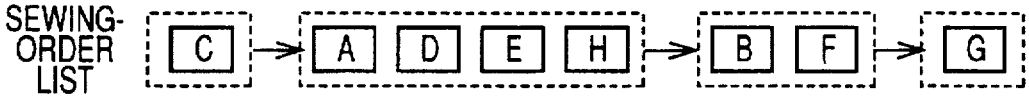
FIG. 9E is a view of a final sewing-order list which is provided as an output of Step S1 of the flow chart of FIG. 3.

Then, Steps S12 through S15 are repeated so that at Step S12 the CPU 20 provides a group list shown in FIG. 9D or FIG. 9E, at Step S13 each of the two red-thread groups is input in the sewing-order list as shown in FIG. 9D or FIG. 9E, at Step S14 the CPU 20 judges whether only a single group is identified at Step S12, and at Step S15 the CPU 20 provides a group list shown in FIG. 8D or FIG. 8E.

If a positive judgment is made at Step S14, this routine is ended, and the control of the CPU 20 goes to Step S2 of FIG. 3. FIG. 9E shows a final sewing-order list as an output from Step S1 of FIG. 3.

At Step S2, the CPU 20 determines an order of sewing of patterns in each of the non-overlapping-pattern groups contained in the final sewing-order list of FIG. 9E. This sewing order may be determined in such a way that the order of sewing of the patterns of each group in the initial sewing order is maintained, or otherwise in such a way that the sum of respective lengths of transfer stitches each formed to connect between two patterns is minimized.

When the routine of FIG. 3 ends with Step S2, the initial sewing order shown in FIG. 6A for the embroidery patterns A to H shown in FIG. 5 is changed to a second changed sewing order shown in FIG. 6C in which three sewing-thread changes are needed that are much smaller than the six changes needed for the initial sewing order shown in FIG. 6A. In addition, in the second changed sewing order of FIG. 6C, the order of sewing of the overlapping patterns of each of the three overlapping-pattern groups in the initial sewing order of FIG. 6A is maintained. Accordingly, for example, the pattern C to be sewn under the pattern D in the initial order is sewn under the pattern D also in the changed order of FIG. 6C.

While in the first embodiment shown in FIGS. 1 to 4, the data processing apparatus 8 is used to process sets of embroidery data each of which includes a set of sewing-thread designating data designating a sewing thread having a particular attribute (e.g., color) and a set of embroidery-area defining data defining an outline of an embroidery pattern, the principle of the present invention may be applied to processing other sorts of embroidery data or more generally sets of sewing data which are needed to control a sewing machine to sew sewing patterns in a predetermined order, into processed sets of sewing data indicative of the sewing patterns in a changed order. Each set of sewing data may comprise sets of stitch-position representative of stitch positions where a sewing needle of the sewing machine penetrates a work sheet to form stitches of a corresponding stitch pattern. For example, a set of embroidery data may include a set of embroidery-area defining data defining an elongate embroidery area which are filled with zigzag stitches, i.e., reference-line data defining a reference line along which the zigzag stitches are formed, and width data indicative of a width of the elongate area, i.e., a length of the zigzag stitches. In the latter case, at Step S11 of FIG. 4, the control device 1 determines the outline of the elongate embroidery area or pattern based on the reference-line data and the width data. A set of sewing data may include a set of reference-line defining data defining a reference line on which running stitches are formed. In the last case, at Step S11, the control device 1 finds an outline and a reference line which overlap each other, or two overlapping reference lines, by judging whether the two lines have one or more intersections and/or judging whether one of the two lines is completely contained in the other line (i.e., outline).

Figure 11A:
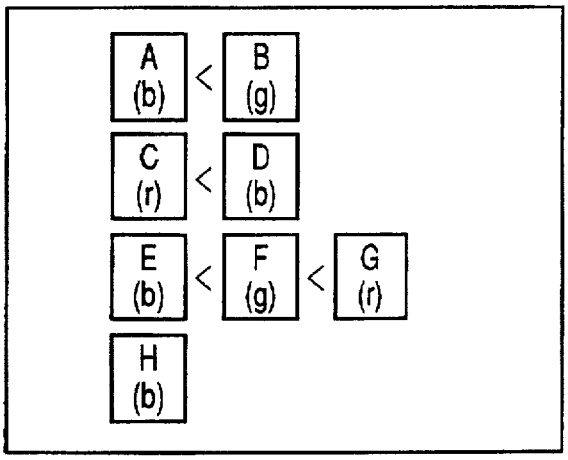
FIG. 11A is the same as FIG. 8A.
Figure 11B:
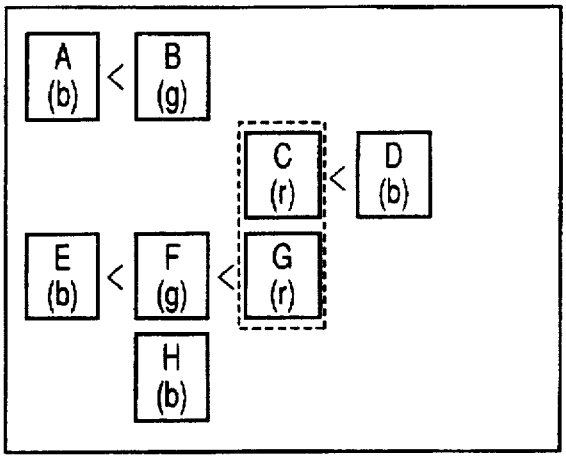
FIG. 11B is a view of a specified one of the non-overlapping-pattern groups found in the embroidery patterns of FIG. 5 which one group is not the largest one, so that the non-overlapping patterns of the specified group are consecutively sewn with a corresponding common sewing thread by the sewing machine of FIG. 1.
Figure 11C:
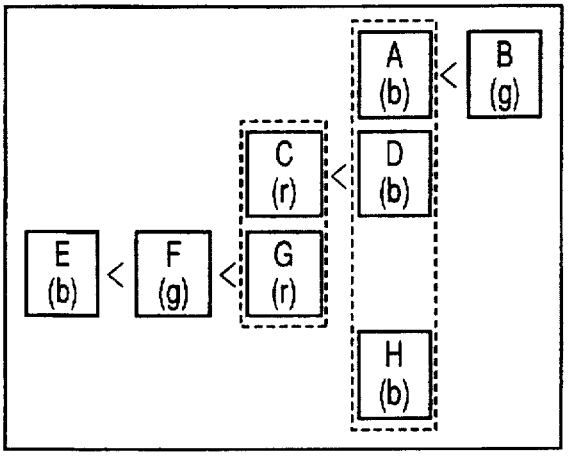
FIG. 11C is a view of the currently largest non-overlapping-pattern group found in the other embroidery patterns of FIG. 5 than the non-overlapping patterns of the specified group of FIG. 11B.
Figure 11D:
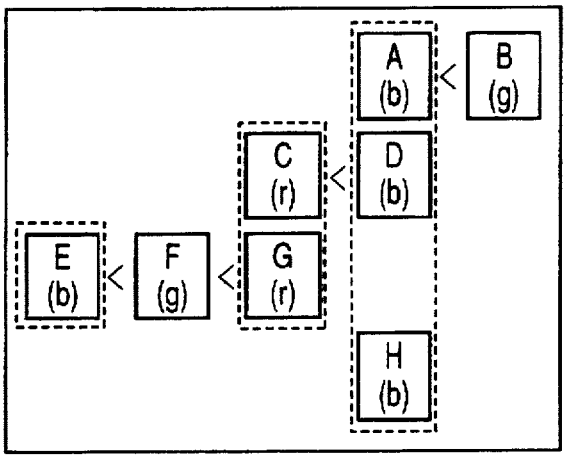
FIG. 11D is a view of the currently largest non-overlapping-pattern group (i.e., single pattern, E, in this example) found in the remaining patterns.
Figure 11E:
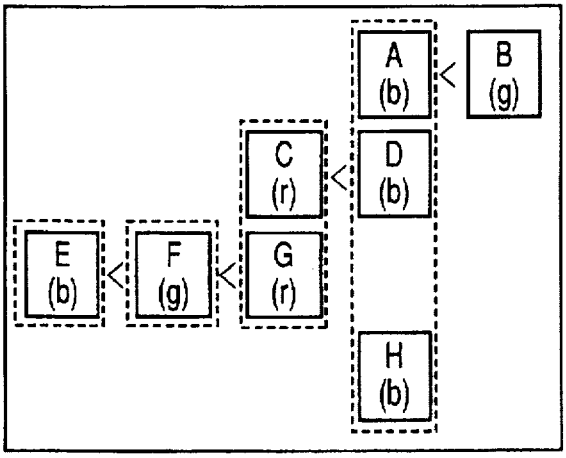
FIG. 11E is a view of the currently largest non-overlapping-pattern group (i.e., single pattern, F, in this example) found in the remaining patterns.
Figure 11F:
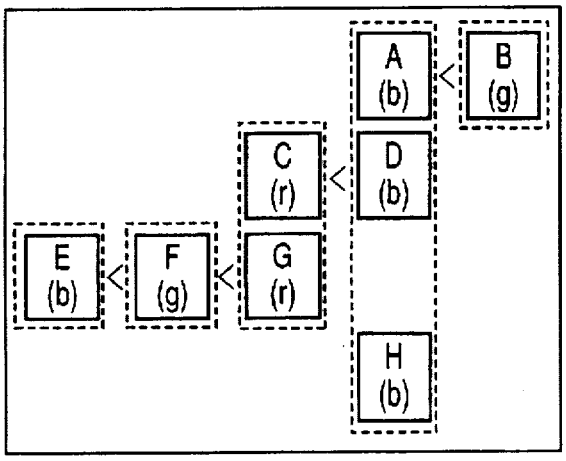
FIG. 11F is a view of the currently largest non-overlapping-pattern group (i.e., single pattern, B, in this example) found in the remaining patterns.

In the first embodiment, at Step S13 of FIG. 4, the control device 1 or the CPU 20 selects one of the non-overlapping-pattern groups which consists of the greatest number of non-overlapping patterns of all the non-overlapping-pattern groups. Owing to this, the number of sewing-thread changes needed to sew the sewing patterns is effectively decreased. On the other hand, if as shown in FIG. 11B the red-sewing-thread pattern group is selected as a first non-overlapping-pattern group from the pattern groups shown in FIG. 9A and, as shown in FIG. 11C, the black-sewing-thread pattern group is selected as a second non-overlapping-pattern group, the predetermined sewing order of the patterns A to H is changed to a changed sewing order shown in FIG. 11F in which four sewing-thread changes are needed that are greater than three changes needed in the changed sewing order shown in FIG. 8E.

In the first embodiment, the data input device including the keyboard 3 and the mouse 4 provides a data obtaining device for obtaining sets of sewing data which are needed to control the sewing machine 10 to sew sewing patterns in a predetermined order; the control device 1 or CPU 20 which reads sets of sewing data from the external memory device 5 functions as a data reading device which also provides the data obtaining device; Step S13 and a portion of the control device 1 for carrying out Step S13 provides an order-changing device for changing the predetermining order to a changed order; Step S11 and a portion of the control device 1 for carrying out Step S11 provides a first searching device for searching the sewing patterns for finding one or more overlapping-pattern groups each of which consists of a plurality of overlapping patterns which overlap each other; Step S12 and a portion of the control device 1 for carrying out Step S12 provides a second searching device for searching the sewing patterns for finding a first non-overlapping-pattern group which consists of a plurality of non-overlapping patterns which correspond to a plurality of sets of sewing data including respective sets of designating data commonly designating a first one of the sewing threads and which do not overlap each other; Step S15 and a portion of the control device 1 for carrying out Step S15 provides a data-modifying device for modifying the sets of sewing data by regarding the non-overlapping patterns of the first non-overlapping-pattern group as a single pattern with respect to the remaining patterns of the sewing patterns, and regarding at least one of the remaining patterns which overlaps at least one of the non-overlapping patterns of the first non-overlapping-pattern group, as overlapping the single pattern such that the one remaining pattern precedes the single pattern in the changed order when the one remaining pattern precedes the one non-overlapping pattern in the predetermined order and such that the one remaining pattern follows the single pattern in the changed order when the one remaining pattern follows the one non-overlapping pattern in the predetermined order; Step S12 and the portion of the control device 1 for carrying out Step S12 provides the second searching device for searching the single pattern and the remaining patterns of the sewing patterns for finding a second non-overlapping-pattern group which consists of a plurality of non-overlapping patterns which correspond to a plurality of sets of sewing data including respective sets of designating data commonly designating a second one of the sewing threads and which do not overlap each over; and a portion of the control device 1 for repeating Steps S12 through S15 provides a repeating device for repeating respective operations of the second searching device and the data-modifying device until the second searching means finds no non-overlapping-pattern group. The pattern groups shown in FIG. 8A or FIG. 11A correspond to the overlapping-pattern groups; the black-sewing-thread pattern group shown in FIG. 8B or the red-sewing-thread pattern group shown in FIG. 11B corresponds to the first non-overlapping-pattern group; and the green-sewing-thread pattern group shown in FIG. 8C or the black-sewing-thread pattern group shown in FIG. 11C corresponds to the second non-overlapping-pattern group.

In the first embodiment, at Step S11, the control device 1 or the CPU 20 finds an overlapping-pattern group which consists of the overlapping patterns which actually overlap each other in the x-y coordinate system prescribed for the sewing machine 10. That is, the control device 1 identifies two overlapping patterns by judging whether the respective outlines of two embroidery patterns have one or more intersections. However, the control device 1 may otherwise be adapted to identify two overlapping patterns by judging whether the respective circumscribing rectangles of two embroidery or sewing patterns overlap each other, i.e., whether at least one of the four vertices of one of the two rectangles falls in an inside area of the other rectangle in the x-y coordinate system. A pair of opposite sides of each circumscribing rectangle are parallel to the x axis of the x-y coordinate system and the other pair of opposite sides of the same are parallel to the y axis. This judgment can be made more quickly than the judgment made at Step S11 in the first embodiment. However, in the latter case, the accuracy of judgment, i.e., accuracy of identification of overlapping patterns may be lowered. Therefore, the average number of non-overlapping patterns belonging to each non-overlapping-pattern group may be decreased and accordingly the number of sewing-thread changes may be increased.

In the first embodiment, at Step S12, the control device 1 may be adapted to regard, as a single pattern, two or more overlapping patterns of each overlapping-pattern group found at Step S11 which patterns correspond to two or more sets of embroidery data including respective sets of designating data commonly designating one of the sewing threads and which are consecutively sewn with the one sewing thread in the initial order shown in FIG. 6A. The two or more overlapping patterns could have been input or read as a single pattern defined by a single set of embroidery data.

While the foregoing description of the first embodiment shown in FIGS. 1–4 relates to the example of embroidery patterns A to H shown in FIG. 5, the data processing apparatus 8 can process sets of sewing data corresponding to sewing patterns including no overlapping-pattern group, i.e., no overlapping pattern. In the latter case, the control device 1 or the CPU 20 changes, according to the flow charts of FIGS. 3 and 4, an initial sewing order of the sewing patterns to a changed sewing order in which two or more sewing patterns corresponding to two or more sets of sewing data including respective sets of designating data commonly designating each of sewing threads, are consecutively sewn with the each sewing thread by the sewing machine 10. For example, if the embroidery patterns A to H shown in FIG. 5 include no overlapping pattern, the four patterns A, D, E, H of the black-sewing-thread pattern group, the two patterns C, G of the red-sewing-thread pattern group, and the two patterns B, F of the green-sewing-thread pattern group are consecutively sewn with the black, red, and green sewing threads, respectively.

In the first embodiment, the control device 1 or the CPU 20 may be adapted to change the initial sewing order shown in FIG. 6A, to a changed order such that a sum of each number of the sewing patterns which correspond to sets of sewing data including respective sets of designating data commonly designating each of the sewing threads and which are consecutively sewn with the each sewing thread in the changed order takes as great as possible a number. That is, the sum of respective numbers of sewing patterns in the changed number each number of which means a number of the sewing patterns consecutively sewn with a corresponding one of the sewing threads takes as great as possible a number. For example, subject to the condition that the order of sewing of overlapping patterns of each overlapping-pattern group in relation with each other in the initial sewing order is maintained in a changed sewing order, the control device 1 may determine all possible changed sewing orders, calculate the above-described sum of respective numbers of sewing patterns with respect to each of the possible changed orders, and select the greatest one of all the calculated sums. For example, regarding the changed sewing order shown in FIG. 8E or 9E the calculated sum is six and, regarding the changed sewing order shown in FIG. 11F the calculated sum is five. If all the possible changed orders were the two orders shown in FIG. 8E and 11F, the control device 1 would select the order of FIG. BE.

Figure 12:
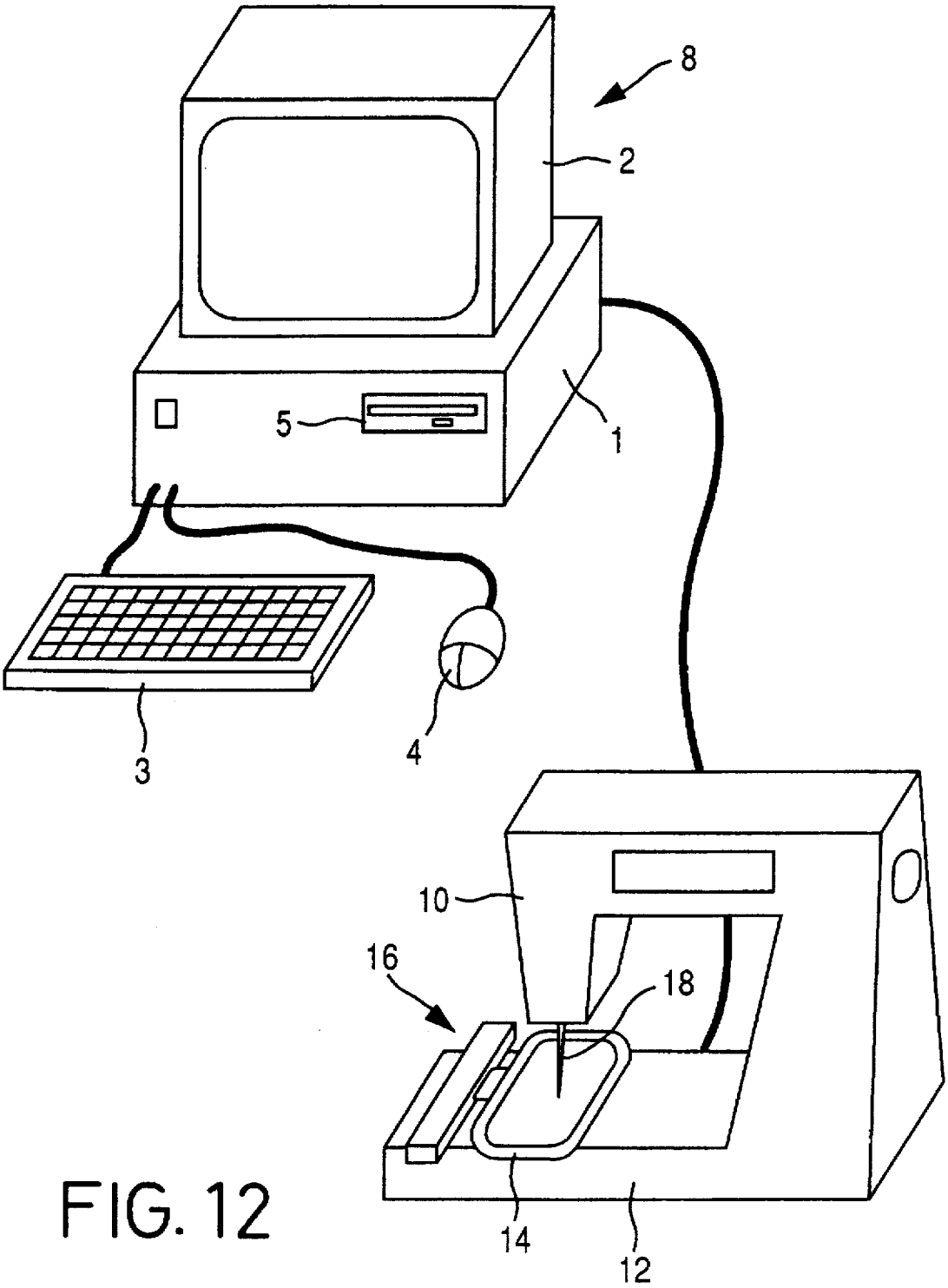
FIG. 12 is a view corresponding to FIG. 1, showing another embroidery-data processing apparatus and another sewing machine as a second embodiment of the present invention.

In the first embodiment shown in FIG. 1, the data processing apparatus 8 is separate from the sewing machine 10, and the sets of embroidery data indicative of the embroidery patterns in the changed order are stored on the flash-memory card 7. The card 7 is removed from the first flash-memory device 6, and is inserted in the second flash-memory device 11 of the sewing machine 10 so that the sewing machine 10 sews the embroidery patterns in the changed order according to the sets of embroidery data recorded on the card 7. Thus, it can be said that the data processing apparatus 8 is indirectly connected to the sewing machine 10. However, the data processing apparatus 8 may directly be connected to the sewing machine 10 via a data cable 40, as shown in FIG. 12. In the latter case, sets of embroidery or sewing data produced by the processing apparatus 8 are transmitted via the cable 40 to the sewing machine 10, so that the sewing machine 10 sews embroidery or sewing patterns in a changed order according to the sets of embroidery or sewing data received from the processing apparatus 8. The first and second flash-memory devices 6, 11 employed in the first embodiment may be employed also in the second embodiment shown in FIG. 12, although not shown in the figure.

In each of the first and second embodiments, the control device (not shown) of the sewing machine 10 functions as a stopping device which stops a stitch-forming operation of the stitch-forming device (e.g., moving device 16, sewing needle 18, etc.) to change the preceding one of two different sewing threads to the following, other sewing thread when the two different sewing threads are designated by the respective sets of designating data of two sets of sewing data which are consecutively used to control the sewing machine 10 to consecutively sew the corresponding two sewing patterns on the work sheet held by the work-sheet holder 14.

While the present invention has been described in its preferred embodiments, it is to be understood that the present invention may be embodied with other changes, improvements, and modifications that may occur to those skilled in the art without departing from the scope and spirit of the invention defined in the appended claims.

What is claimed is:

1. An apparatus for processing a plurality of sets of sewing data, each set of which is needed to control a sewing machine to sew, on a work sheet, a corresponding one of a plurality of sewing patterns with a corresponding one of a plurality of sewing threads, said each set of sewing data including a set of designating data designating said corresponding one sewing thread, the apparatus comprising:

a data obtaining device which obtains said sets of sewing data which are needed to control the sewing machine to sew said sewing patterns in a predetermined order;

searching means for searching said sewing patterns for finding at least one overlapping-pattern group consisting of a plurality of overlapping patterns which overlap each other; and changing means for, when said sewing patterns include said at least one overlapping-pattern group, changing said predetermined order to a changed order such that an order of sewing of said overlapping patterns in relation with each other in said predetermined order is maintained in said changed order and such that a number of sewing-thread changes needed to sew said sewing patterns in said changed order is smaller than a number of sewing-thread changes needed to sew said sewing patterns in said predetermined order.

2. An apparatus according to claim 1, wherein said changing means comprises means for, when said sewing patterns do not include said overlapping-pattern group, changing said predetermined order to said changed order in which at least two of said sewing patterns corresponding to at least two sets of sewing data including respective sets of designating data commonly designating each of said sewing threads, are consecutively sewn with said each sewing thread by the sewing machine.

3. An apparatus according to claim 1, wherein said searching means comprises means for finding said at least one overlapping-pattern group consisting of said overlapping patterns which actually overlap each other in a two-dimensional coordinate system corresponding to the work sheet.

4. An apparatus according to claim 1, wherein said searching means comprises means for finding said at least one overlapping-pattern group consisting of said overlapping patterns having respective circumscribing rectangles which overlap each other in a two-dimensional coordinate system corresponding to the work sheet.

5. An apparatus according to claim 1, wherein said changing means comprises means for changing said predetermined order to said changed order such that a number of the sewing patterns which correspond to sets of sewing data including respective sets of designating data commonly designating one of said sewing threads and which are consecutively sewn with said one sewing thread in said changed order, is greater than a number of the sewing patterns which correspond to sets of sewing data including respective sets of designating data commonly designating said one sewing thread and which are consecutively sewn with said one sewing thread in said predetermined order.

6. An apparatus according to claim 1, wherein said changing means comprises means for changing said predetermined order to said changed order such that a number of the sewing patterns which correspond to sets of sewing data including respective sets of designating data commonly designating each of at least two of said sewing threads and which are consecutively sewn with said each sewing thread in said changed order, is greater than a number of the sewing patterns which correspond to sets of sewing data including respective sets of commonly designating data commonly designating said each sewing thread and which are consecutively sewn with said each sewing thread in said predetermined order.

7. An apparatus according to claim 1, wherein said changing means comprises means for changing said predetermined order to said changed order such that a sum of each number of the sewing patterns which correspond to sets of sewing data including respective sets of designating data commonly designating each of said sewing threads and which are consecutively sewn with said each sewing thread in said changed order, is greater than a sum of each number of the sewing patterns which correspond to sets of sewing data including respective sets of designating data commonly designating said each sewing thread and which are consecutively sewn with said each sewing thread in said predetermined order.

8. An apparatus according to claim 1, wherein said changing means comprises means for changing said predetermined order to said changed order such that a sum of each number of the sewing patterns which correspond to sets of sewing data including respective sets of designating data commonly designating each of said sewing threads and which are consecutively sewn with said each sewing thread in said changed order takes as great as possible a number.

9. An apparatus according to claim 1, wherein said changing means comprises searching means for searching said sewing patterns for finding a first non-overlapping-pattern group consisting of a plurality of non-overlapping patterns which correspond to at least two sets of sewing data including respective sets of designating data commonly designating a first one of said sewing threads and which do not overlap each other, and wherein said changing means changes said predetermined order to said changed order in which said non-overlapping patterns of said first non-overlapping-pattern group are consecutively sewn with said first sewing thread.

10. An apparatus according to claim 9, wherein said changing means further comprises data-modifying means for regarding said non-overlapping patterns of said first non-overlapping-pattern group as a single pattern with respect to the remaining patterns of said sewing patterns, and regarding at least one of said remaining patterns which overlaps at least one of said non-overlapping patterns of said first non-overlapping-pattern group, as overlapping said single pattern such that said one remaining pattern precedes said single pattern in said changed order when said one remaining pattern precedes said one non-overlapping pattern in said predetermined order and such that said one remaining pattern follows said single pattern in said changed order when said one remaining pattern follows said one non-overlapping pattern in said predetermined order, and wherein said searching means searches said single pattern and said remaining patterns for finding a second non-overlapping-pattern group consisting of a plurality of non-overlapping patterns which correspond to at least two sets of sewing data including respective sets of designating data commonly designating a second one of said sewing threads and which do not overlap each over, and said changing means changes said predetermined order to said changed order in which said non-overlapping patterns of said second non-overlapping-pattern group are consecutively sewn with said second sewing thread.

11. An apparatus according to claim 10, wherein said changing means further comprises repeating means for repeating respective operations of said searching means and said data-modifying means until said searching means finds no non-overlapping-pattern group consisting of a plurality of non-overlapping patterns which correspond to at least two sets of sewing data including respective sets of designating data commonly designating any one of said sewing threads and which do not overlap each over.

12. An apparatus according to claim 9, wherein said changing means further comprises selecting means for, when said searching means finds a plurality of non-overlapping-pattern groups, selecting, as said first non-overlapping-pattern group, one of said plurality of non-overlapping-pattern groups which consists of a greatest number of the non-overlapping patterns in said plurality of non-overlapping-pattern groups.

13. An apparatus according to claim 9, wherein said searching means comprises means for regarding, as a single pattern, at least two overlapping patterns of said overlapping-pattern group which correspond to at least two sets of sewing data including respective sets of designating data commonly designating one of said sewing threads and which are consecutively sewn with said one sewing thread in said predetermined order.

14. An apparatus according to claim 1, wherein said data obtaining device comprises means for obtaining, as said sets of sewing data, a plurality of sets of embroidery data each of which consists of a set of sewing-thread designating data designating a corresponding one of said sewing threads, and a set of embroidery-area defining data defining, in a two-dimensional coordinate system corresponding to the work sheet, an embroidery area which is filled with stitches formed by the sewing machine.

15. An apparatus according to claim 1, wherein said data obtaining device comprises means for obtaining, as said sets of sewing data, a plurality of sets of embroidery data each of which includes a set of sewing-thread designating data designating a corresponding one of said sewing threads, and sets of stitch-position defining data defining, in a two-dimensional coordinate system corresponding to the work sheet, respective stitch positions at which stitches are formed by the sewing machine.

16. An apparatus according to claim 1, wherein said data obtaining device comprises a data input device which is operable for inputting said sets of sewing data indicative of said sewing patterns in said predetermined order.

17. An apparatus according to claim 1, wherein said data obtaining device comprises a data reading device which reads, from an external data memory, said sets of sewing data indicative of said sewing patterns in said predetermined order.

18. An apparatus according to claim 1, further comprising a utilizing device which utilizes said sets of sewing data indicative of said sewing patterns in said changed order to control the sewing machine to sew the sewing patterns in the changed order on the work sheet.

19. An apparatus according to claim 18, wherein said utilizing device comprises a stitch-forming device of the sewing machine which forms stitches of each of said sewing patterns in said changed order on the work sheet.

20. An apparatus according to claim 18, wherein said utilizing device comprises a stopping device of the sewing machine which stops a stitch-forming operation of a stitch-forming device of the sewing machine to change a preceding one of two different sewing threads to the following, other sewing thread when the two different sewing threads are designated by the respective sets of designating data of the two sets of sewing data which are consecutively used to control the sewing machine to consecutively sew the corresponding two sewing patterns on the work sheet.

21. An apparatus according to claim 18, wherein said utilizing device comprises a data recording device which records, in an external data memory, said sets of sewing data indicative of said sewing patterns in said changed order to control the sewing machine to sew the sewing patterns in the changed order on the work sheet.

22. An apparatus for processing a plurality of sets of sewing data each set of which is needed to control a sewing machine to sew, on a work sheet, a corresponding one of a plurality of sewing patterns with a corresponding one of a plurality of sewing threads, said each set of sewing data including a set of designating data designating said corresponding one sewing thread, the apparatus comprising:

a data obtaining device which obtains said sets of sewing data which are used to control the sewing machine to sew said sewing patterns in a predetermined order;

searching means for searching said sewing patterns for finding at least one overlapping-pattern group consisting of a plurality of overlapping patterns which overlap each other; and changing means for, when said sewing patterns includes no said overlapping-pattern group, changing said predetermined order to a changed order in which at least two of said sewing patterns, corresponding to at least two sets of sewing data including respective sets of designating data commonly designating each of said sewing threads, are consecutively sewn with said each sewing thread by the sewing machine.

23. An apparatus according to claim 22, further comprising a utilizing device which utilizes said sets of sewing data indicative of said sewing patterns in said changed order to control the sewing machine to sew the sewing patterns in the changed order on the work sheet.

24. An apparatus for processing a plurality of sets of sewing data each set of which is needed to control a sewing machine to sew, on a work sheet, a corresponding one of a plurality of sewing patterns with a corresponding one of a plurality of sewing threads, said each set of sewing data including a set of designating data designating said corresponding one sewing thread, the apparatus comprising:

a data obtaining device which obtains said sets of sewing data which are needed to control the sewing machine to sew said sewing patterns in a predetermined order;

searching means for searching said sewing patterns for finding a first non-overlapping-pattern group consisting of a plurality of non-overlapping patterns which correspond to at least two sets of sewing data including respective sets of designating data commonly designating a first one of said sewing threads and which do not overlap each other; and changing means for changing said predetermined order to a changed order in which said non-overlapping patterns of said first non-overlapping-pattern group are consecutively sewn with said first sewing thread.

25. An apparatus according to claim 24, further comprising data-modifying means for regarding said non-overlapping patterns of said first non-overlapping-pattern group as a single pattern with respect to the remaining patterns of said sewing patterns, and regarding at least one of said remaining patterns which overlaps at least one of said non-overlapping patterns of said first non-overlapping-pattern group, as overlapping said single pattern such that said one remaining pattern precedes said single pattern in said changed order when said one remaining pattern precedes said one non-overlapping pattern in said predetermined order and such that said one remaining pattern follows said single pattern in said changed order when said one remaining pattern follows said one non-overlapping pattern in said predetermined order, and wherein said searching means searches said single pattern and said remaining patterns for finding a second non-overlapping-pattern group consisting of a plurality of non-overlapping patterns which correspond to at least two sets of sewing data including respective sets of designating data commonly designating a second one of said sewing threads and which do not overlap each other, and said changing means changes said predetermined order to said changed order in which said non-overlapping patterns of said second non-overlapping-pattern group are consecutively sewn with said second sewing thread.

26. An apparatus according to claim 25, further comprising repeating means for repeating respective operations of said searching means and said data-modifying means until said searching means finds no non-overlapping-pattern group consisting of a plurality of non-overlapping patterns which correspond to at least two sets of sewing data including respective sets of designating data commonly designating any one of said sewing threads and which do not overlap each other.

27. An apparatus according to claim 24, further comprising selecting means for, when said searching means finds a plurality of non-overlapping-pattern groups, selecting, as said first non-overlapping-pattern group, one of said plurality of non-overlapping-pattern groups which consists of a greatest number of the non-overlapping patterns in said plurality of non-overlapping-pattern groups.

28. An apparatus according to claim 24, wherein said searching means comprises means for regarding, as a single pattern, at least two overlapping patterns of an overlapping-pattern group which correspond to at least two sets of sewing data including respective sets of designating data commonly designating one of said sewing threads and which are consecutively sewn with said one sewing thread in said predetermined order.

29. An apparatus according to claim 28, wherein said searching means comprises means for searching said sewing data for searching patterns for finding said overlapping-pattern group.

* * * * *